United States Patent [19]

Kamon et al.

[11] 4,376,233

[45] Mar. 8, 1983

[54] SECURING OF LEAD WIRES TO ELECTRO-ACOUSTIC TRANSDUCERS

[75] Inventors: Yoshiyuki Kamon; Yoshihiro Yokoyama, both of Kanagawa, Japan

[73] Assignee: Sony Corporation, Tokyo, Japan

[21] Appl. No.: 217,817

[22] Filed: Dec. 18, 1980

[51] Int. Cl.[3] ..... H04R 1/06; H04R 9/04

[52] U.S. Cl. ..... 179/115.5 VC

[58] Field of Search ..... 179/115.5 VC, 115, 181, 179/115.5 R; 181/165

[56] References Cited

U.S. PATENT DOCUMENTS

| | | | |
|---|---|---|---|
| 2,006,857 | 7/1935 | Engholm | 179/115.5 VC |
| 4,315,112 | 2/1982 | Hofer | 179/115.5 VC |
| 4,317,965 | 3/1982 | Toyoda | 179/115.5 VC |

*Primary Examiner*—Stafford D. Schreyer

*Attorney, Agent, or Firm*—Hill, Van Santen, Steadman, Chiara & Simpson

[57] ABSTRACT

An electro-acoustic transducer of the dynamic type, particularly a small loudspeaker or microphone, such as a loudspeaker for use in headphones, comprises a magnetic circuit including an air gap, a diaphragm having a voice coil disposed in the air gap, and lead wires for the voice coil, the lead wires extending substantially tangentially from the voice coil and being bonded to the diaphragm by two different kinds of adhesive, a relatively hard adhesive being used near the voice coil and a relatively soft adhesive being used near the periphery of the diaphragm.

8 Claims, 4 Drawing Figures

SECURING OF LEAD WIRES TO ELECTRO-ACOUSTIC TRANSDUCERS

BACKGROUND OF THE INVENTION

1. Field of the Invention

This invention relates to electro-acoustic transducers, and more particularly, but not exclusively, to relatively small loudspeakers for use in headphones. The invention is also applicable to loudspeakers of other sizes and for other purposes, and also to microphones.

2. Description of the Prior Art

Generally, a relatively small electro-acoustic transducer such as a loudspeaker for use in headphones includes a magnetic circuit and a diaphragm which comprises a dome-shaped central portion and a ring-shaped peripheral portion to be fixed to a frame. A voice coil is fixed to the diaphragm where the central and peripheral portions of the diaphragm meet, and is disposed in an air gap formed in the magnetic circuit.

Lead wires for the voice coil extend radially along the undersurface to the peripheral portion of the diaphragm and are bonded thereto by a suitable adhesive. Beyond the adhesive, unsupported portions of the lead wires are bent at right angles at or near the periphery of the diaphragm in order to be connected to terminals provided on an outside surface of the frame.

When the diaphragm vibrates with a large amplitude, it is not uncommon for the lead wires to snap. This is because the portions of the lead wires fixed to the peripheral portion of the diaphragm move together with the diaphragm, but the bent portions of the lead wires are not supported and moreover are bent at right angles, so that after a time the wire suffers from metal fatigue and may become brittle and snap. The radial disposition of the lead wires also causes problems as they contact the peripheral portion of the diaphragm when the diaphragm vibrates with large amplitude, and this generates noise.

SUMMARY OF THE INVENTION

One object of the present invention is to provide an improved electro-acoustic transducer.

Another object of the present invention is to provide an electro-acoustic transducer such as a dynamic loudspeaker in which the risk of snapping of the lead wires of the voice coil is reduced.

Another object of the present invention is to provide an electro-acoustic transducer which has relatively long lead wires for the voice coil.

Another object of the present invention is to provide an electro-acoustic transducer such as a small-sized dynamic loudspeaker, in which the lead wires for the voice coil are bonded by two kinds of adhesive, to reduce the risk of the lead wires snapping.

Another object of the present invention is to provide an electro-acoustic transducer which generates a clear sound.

Another object of the present invention is to provide an electro-acoustic transducer which can easily be constructed and assembled.

According to the present invention there is provided an electro-acoustic transducer comprising:

a mounting member;

a magnetic circuit secured to said mounting member and having an air-gap;

a diaphragm having a peripheral portion secured to said mounting member; and a cylindrical voice coil secured to said diaphragm and extending into said air gap of said magnetic circuit, said voice coil having lead wires which extend from said voice coil in a substantially tangential direction towards the periphery of said diaphragm, said lead wires being bonded to said diaphragm by adhesive.

According to the present invention there is also provided an electro-acoustic transducer comprising:

a mounting member;

a magnetic circuit secured to said mounting member and having an air gap;

a diaphragm having an edge portion fixed to said mounting member;

a cylindrical voice coil mounted on said diaphragm and extending into said air gap of said magnetic circuit;

lead wires extending from said voice coil in the direction of the edge portion of said diaphragm along the surface of said diaphragm; and adhesives of two different hardnesses bonding said lead wires to said diaphragm, a relatively hard adhesive being used for the portions of said lead wires nearer said voice coil and a relatively soft adhesive being used for portions of said lead wires nearer the edge portion of said diaphragm.

The above, and other objects, features and advantages of this invention will be apparent from the following detailed description of illustrative embodiments which is to be read in connection with the accompanying drawings.

DESCRIPTION OF THE PREFERRED EMBODIMENTS

The embodiments to be described are small-sized electro-acoustic transducers forming loudspeakers suitable for use in headphones.

Figure 1:
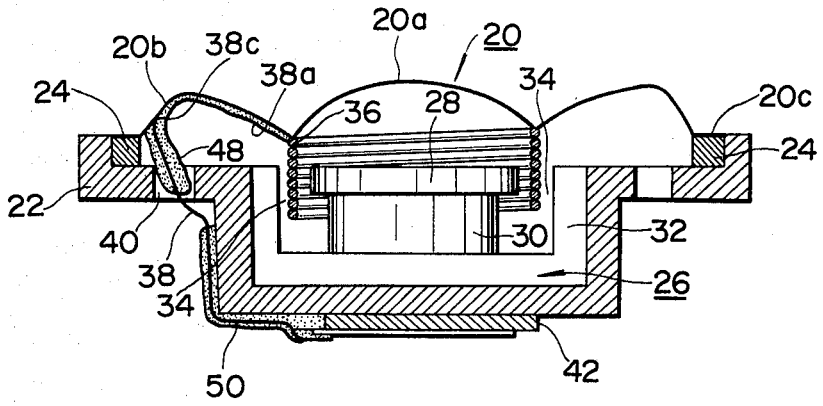
FIG. 1 shows a cross-sectional view of an embodiment of electro-acoustic transducer according to the invention.

The transducer of FIG. 1, to which reference is now made, comprises a small-sized diaphragm 20 formed by a film of plastics material, a magnetic circuit 26 and a mounting member formed by a moulded frame 22 of plastics material to which the magnetic circuit 26 and the diaphragm 20 are secured. The diaphragm 20 comprises a dome-shaped central portion **20*a* and a ring-shaped peripheral portion 20*b* contiguous to the central portion 20*a*, an edge portion 20*c* of the peripheral portion 20*b* being fixed to the frame 22 through a suitable ring 24**.

The magnetic circuit 26 comprises a circular plate 28, a permanent magnet 30 and a yoke 32, an air gap 34 being formed between the plate 28 and the yoke 32. A cylindrical voice coil 36 is secured to the boundary region between the central portion **20*a* and the peripheral portion 20*b* of the diaphragm 20 by a suitable adhesive, and is disposed so as to extend into the air gap 34. The voice coil 36** does not have a bobbin.

Figure 2:
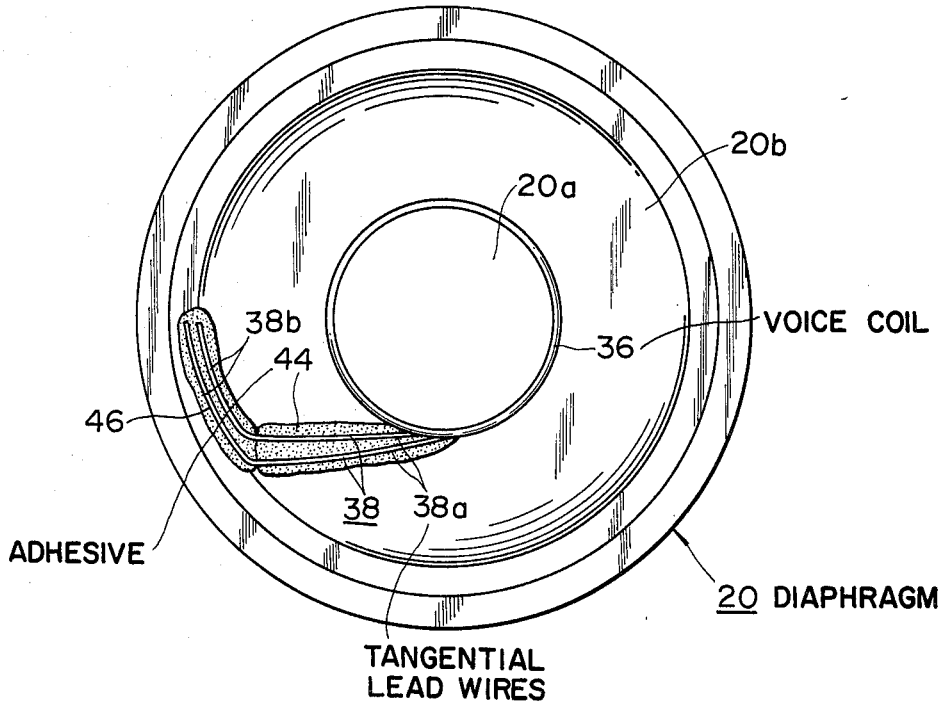
FIG. 2 shows a bottom plan view and in particular a voice coil and lead wires of the transducer of FIG. 1.
Figure 3:
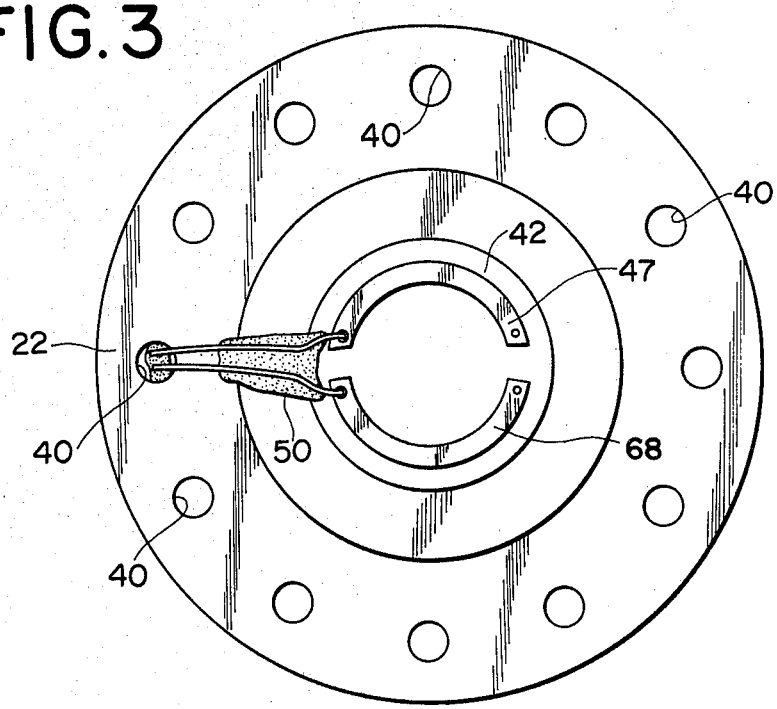
FIG. 3 shows another bottom plan view of the transducer of FIG. 1.

As also seen in FIG. 2, lead wires 38 for the voice coil 36 have tangential portions 38*a* which extend substantially tangentially from the voice coil 36 and which then merge into circular arc portions 38*b* which extend along the peripheral portion 20*b* of the diaphragm 20 close to the ring 24. The circular arc portions 38*b* then bend away from the diaphragm 20 as shown in FIG. 1, to extend through an opening 40 formed in the frame 22 and are connected to terminals 47 and 68 which are mounted on an insulating plate 42 mounted on the outer surface of the frame 22 as also seen in FIG. 3.

With this embodiment, the tangential portions 38*a* of the lead wires 38 are bonded to the undersurface of the diaphragm 20 by an adhesive 44 which is relatively hard. The adhesive 44 may for example be a rubber system adhesive, such as a solvent type of chloroprene, for example DB-4378, this being a Trade Name of DB Bond Corporation. The circular arc portions 38*b* of the lead wires 38 are bonded to the diaphragm 20 by an adhesive 46 which is relatively soft. This may for example be an acrylic system adhesive, for example, SC-717, this being a Trade Name of Sony Chemical Corporation. Moreover, the lead wires 38 are located in the opening 40 by an adhesive 48 which may be the same acrylic system adhesive just mentioned. Finally, the end portions of the lead wires 38 nearest to the terminals 47 and 68 may be bonded by an epoxy system adhesive 50.

Thus in this embodiment the lead wires 38 of the voice coil 36 are bonded to the diaphragm 20 by two different kinds of adhesive, having different hardnesses, the relatively hard adhesive being nearer the voice coil 36 and the relatively soft adhesive being nearer the edge portion 20*c* of the diaphragm 20. This means that the portions of the lead wires 38 nearer to the voice coil 36, that is the tangential portions 38*a* vibrate together with the voice coil 36 as one body. However, the circular arc portions 38*b* of the lead wires 38, that is the portions near the edge portion 20*c* of the diaphragm 20 vibrate with the voice coil 36 as one body when the voice coil 36 vibrates with only a comparatively small amplitude, but if the voice coil 36 vibrates with a relatively large amplitude, the circular arc portions 38*b* of the lead wires 38 are able to move relative to the adhesive 46, due to the softness of the adhesive 46. The same effect tends to occur if a large external force is applied to the peripheral portion 20*b* of the diaphragm 20. This means that in such cases the forces applied to the lead wires 38 tend to be absorbed in the adhesives, particularly the adhesive 46, and this reduces forces acting in particular on the bent portions 38*c* of the lead wires 38, and reduces the tendency for the lead wires 38 to snap.

Figure 4:
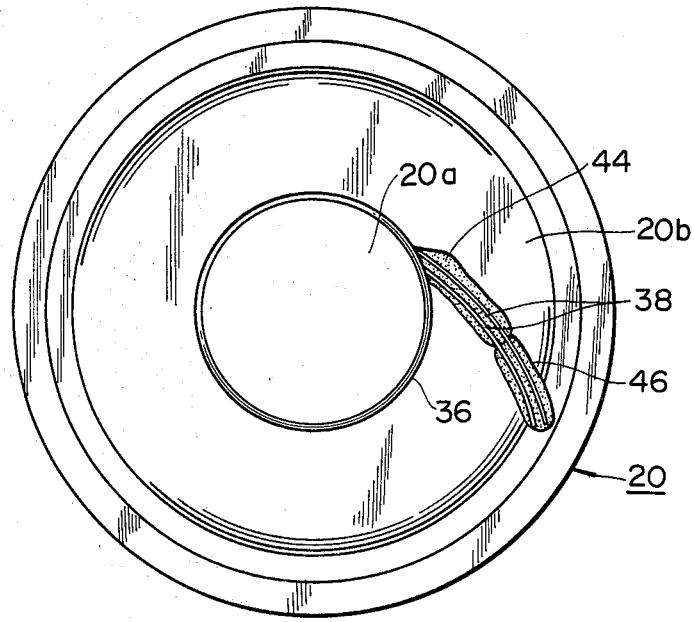
FIG. 4 shows a bottom plan view of another embodiment of electro-acoustic transducer according to the invention.

In the modified embodiment shown in FIG. 4, to which reference is now made, lead wires 38 extend substantially tangentially from a voice coil 36, but form a circular arc and so take a relatively long path between the voice coil 36 and the outer edge of the peripheral portion 20*b* of the diaphragm 20. Portions of the lead wires 38 nearer the voice coil 36 are bonded to the diaphragm 20 by a relatively hard adhesive 44 such as a rubber system adhesive, and portions of the lead wires 38 further from the voice coil 36 and nearer to the outer edge of the peripheral portion 20*b* of the diaphragm 20 are bonded to the diaphragm 20 by a relatively soft adhesive 46, such as an acrylic system adhesive. As in the first embodiment described above, therefore, the tendency for the lead wires 38 to be subjected to excessive forces and hence to snap is reduced.

Thus in embodiments of the invention the lead wires of a voice coil extend from the voice coil to a peripheral portion of the diaphragm along a circular arc, so as to take a long path relative to the radial path used in the prior art. This reduces the forces acting on the lead wires and reduces the possibility of the lead wires snapping. Also, two different kinds of adhesive of different hardnesses may be used for securing the lead wires, and this also contributes to reducing the risk of the lead wires snapping. This is particularly effective where the lead wires extend along the periphery of the diaphragm and are secured by a relatively soft adhesive, as described with reference to FIG. 2. Moreover, the provision of a relatively soft adhesive, such as an acrylic system adhesive, has a damping effect on the lead wires and reduces the possibility of unwanted noise being generated by contact between the lead wires and the diaphragm.

Although the embodiments described are small-sized loudspeakers, the invention can also be applied to loudspeakers of other sizes and also to microphones of dynamic type.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

We claim:

1. An electro-acoustic transducer comprising: a mounting member; a magnetic circuit secured to said mounting member and having an air-gap; a diaphragm having a peripheral portion secured to said mounting member; a cylindrical voice coil secured to said diaphragm and extending into said air gap of said magnetic circuit, said voice coil having lead wires with first ends which are attached to and having first portions which extend from said voice coil in a substantially tangential direction towards the periphery of said diaphragm, said lead wires having second portions bonded to said diaphragm by adhesive, and a pair of electrical terminals attached to said mounting member and second ends of said lead wires connected respectively to said pair of electrical terminals.

2. An electro-acoustic transducer according to claim 1 wherein said second portions of said lead wires have circular arc portions connected to said first portions and extend along a peripheral portion of said diaphragm, said second circular arc portions being bonded to said diaphragm by adhesive.

3. An electro-acoustic transducer according to claim 1 wherein said adhesive comprises adhesives of two different hardnesses, a relatively hard adhesive being used for said first portions of the lead wires nearer said voice coil, and a relatively soft adhesive being used for said second circular arc portions of said lead wires nearer the periphery of said diaphragm.

4. An electro-acoustic transducer according to claim 3 wherein said relatively hard adhesive is a rubber system adhesive and said relatively soft adhesive is an acrylic system adhesive.

5. An electro-acoustic transducer according to claim 3 further comprising terminals to which said lead wires are connected, said lead wires extending from said diaphragm towards said terminals by way of bent portions of said lead wires which are coated with a relatively soft adhesive.

6. An electro-acoustic transducer comprising: a mounting member; a magnetic circuit secured to said mounting member and having an air gap; a diaphragm having an edge portion fixed to said mounting member; a cylindrical voice coil mounted on said diaphragm and extending into said air gap of said magnetic circuit; a pair of lead wires with first ends which are attached to and have first portions which extend from said voice coil and second portions attached to said first portions and extend in the direction of the edge portion of said diaphragm along the surface of said diaphragm; adhesives of two different hardnesses bonding said lead wires to said diaphragm, a relatively hard adhesive being used for said first portions of said lead wires nearer said voice coil and a relatively soft adhesive being used for said second portions of said lead wires nearer the edge portion of said diaphragm, and a pair of electrical terminals attached to said mounting member, and second ends of said lead wires connected respectively to said pair of electrical terminals.

7. An electro-acoustic transducer according to claim 6 wherein said first portions of said lead wires extend substantially tangentially from said voice coil.

8. An electro-acoustic transducer according to claim 7 wherein said second portions of said lead wires are formed as circular arc portions attached to said first portions and extending along part of the periphery of said diaphragm.

* * * * *